US005425645A

United States Patent [19]

Skovdal et al.

[11] Patent Number: 5,425,645

[45] Date of Patent: Jun. 20, 1995

[54] ELECTRIC POWER CORD CONNECTOR HAVING TWO AXES OF MOVEMENT

[75] Inventors: Jorgen Skovdal, Trumbull; Ha Van Duong, Torrington, both of Conn.

[73] Assignee: Remington Products Company, Bridgeport, Conn.

[21] Appl. No.: 155,442

[22] Filed: Nov. 19, 1993

[51] Int. Cl.[6] ..... H01R 39/04

[52] U.S. Cl. ..... 439/23; 439/6; 439/13

[58] Field of Search ..... 439/6, 10, 11, 13, 18, 439/20, 21, 23, 28, 29

[56] References Cited

U.S. PATENT DOCUMENTS 861,468 7/1907 Kreinsen ..... 439/11

1,981,854 11/1934 Comiskey ..... 439/6

FOREIGN PATENT DOCUMENTS 602824 6/1948 United Kingdom ..... 439/13

*Primary Examiner*—Eugene F. Desmond

*Attorney, Agent, or Firm*—Melvin I. Stoltz

[57] ABSTRACT

An electrical connector device to connect an electric power cord to a hand-held electric appliance, the connector device having an outer case housing with an inner chamber and at least one spring contact extending thereinto; a main housing rotatively supported in the outer case chamber, the main housing having two separated sockets therein, a stepped cylindrical top portion, and a bottom wall with an opening therethrough; at least one conductor compressively positioned on the stepped cylindrical portion of the main housing, the conductor being electrically connected to the power cord and to the spring contact; and a cord bushing having oppositely extending arms and a body portion with a bore therethrough, the power cord extending through the body portion bore, the arms being pivotly mounted in the separated sockets and the body portion extending through the bottom opening of the main housing; wherein the electrical connector device provides the power cord with two free axes of movement.

17 Claims, 2 Drawing Sheets

ELECTRIC POWER CORD CONNECTOR HAVING TWO AXES OF MOVEMENT

FIELD OF THE INVENTION

The present invention relates to flexible electrical power connectors and, more specifically, to a rotatable and pivotable connector useful for hair dryers and other hand-held small appliances.

BACKGROUND OF THE INVENTION

At the present time, electrical power cords are generally connected to hand-held small appliances, such as hair dryers, by passing an electric cord through a resilient sleeve connected to the appliance. However, the sleeve allows for little or virtually no degree of movement in any direction. Thus, when the appliance is turned, the cord may become twisted or even knotted. It is an inconvenience to untangle the cord and a tangled cord may be unsightly. Additionally, twisting of the cord causes much stress and strain of the cord at the point where the cord exits the appliance body, thereby ultimately resulting in a break or split in the insulative outer body of the cord. Once the cord insulation is broken, the electrical wires contained therewithin may be exposed. This poses a high safety concern for the user. Accordingly, by preventing twisting of the cord, we are able to produce a product that is not only convenient, but also much safer and has a longer life.

It has been suggested, in a series of patents, that a commutator-brush type of electrical connection may be used to provide a rotative connector. This permits the appliance to be turned about one axis without twisting the power cord. However, it does not provide for any other movement.

U.S. Pat. No. 4,040,896 ('896 patent), entitled "Electric Device Having Rotary Current Collecting Means", is directed to a three part structure having an inner rotatable electrode carrier ("device body 5"or "first conductor carrier") and a housing ("device body 2").

U.S. Pat. No. 4,061,381 ('381 patent), entitled "Twist Prevention Device", relates to a rotatable cable connector. It shows two helically wound connectors forming a wire spring.

U.S. Pat. No. 3,937,543 ('543 patent), entitled "Electrical Swivel Contact Assembly", relates to a system in which one pair of contacts is spring-biased and another pair of contacts is through the spring.

Other patents on swiveling electrical connections for hand-held appliances are U.S. Pat. Nos. 3,950,052; 4,003,616 and 3,957,331.

OBJECTIVES OF THE INVENTION

It is an object of the present invention to provide an electrical connection between a power cord and a hand-held appliance which permits the appliance to be rotated, about one axis, and pivoted in pendulum fashion, about a different axis, without twisting the power cord.

It is a further object of the present invention that the electrical connection be sturdy and reliable so that power to the appliance is continued even when the appliance is being twisted or moved from side to side.

It is yet a further object of the present invention to provide such a connection for a hand-held hair dryer so that it can be manipulated by the user without tangling or damaging the power cord or interrupting the power, and permits the cord to extend downwardly while the hair dryer is being used.

SUMMARY OF THE INVENTION

The present invention provides an electrical connector between a power cord and a hand-held appliance, such as a hair dryer, in which the appliance may be rotated about one axis, and pivoted like a pendulum about an axis perpendicular to the axis of rotation, without detrimentally twisting the power cord.

The connector comprises two half outer case housings affixed together to form a cylindrical outer case which is an integral part of, or fixed within, a hand-held appliance, such as a hair dryer. The outer case preferably has a cover portion with two slits therein, through which protrude two prong-like spring contacts.

Two cylindrically shaped half inner housings are affixed together to form a rotor-like main housing which is supported and rotatable within the outer case. Two metal conductor slip rings are concentrically fixed onto respective cylindrical portions on the top of the main housing via, for example, a friction fit, and are in continuous electrical contact with the two spring contacts extending from the outer case.

A T-shaped cord bushing has a central vertical bore, through which a power cord passes, and horizontal arms supported within the main housing to drive the main housing in rotating fashion. The vertical portion of the cord bushing extends out of said housings and appliance to provide a pivoting motion to the power cord. The power cord extending through the central bore of the cord bushing enters the main housing and splits into two lead wires, each of which is in electrical connection with one of the metal conductor slip rings positioned atop the main housing.

The cord bushing permits the power cord to have a swing-like pendulum effect without creating any stress or strain on the cord. The rotation of the main housing, which carries the cord bushing therewithin, permits the appliance to be rotated relative to the axis of the power cord without twisting the cord. Thus, the power cord is provided with two axes of movement.

BRIEF DESCRIPTION OF THE DRAWINGS

Other objectives and features of the present invention will be apparent from the following detailed description taken conjunction with the accompanying drawings. In the drawings.

DETAILED DESCRIPTION OF THE INVENTION

Figure 1:
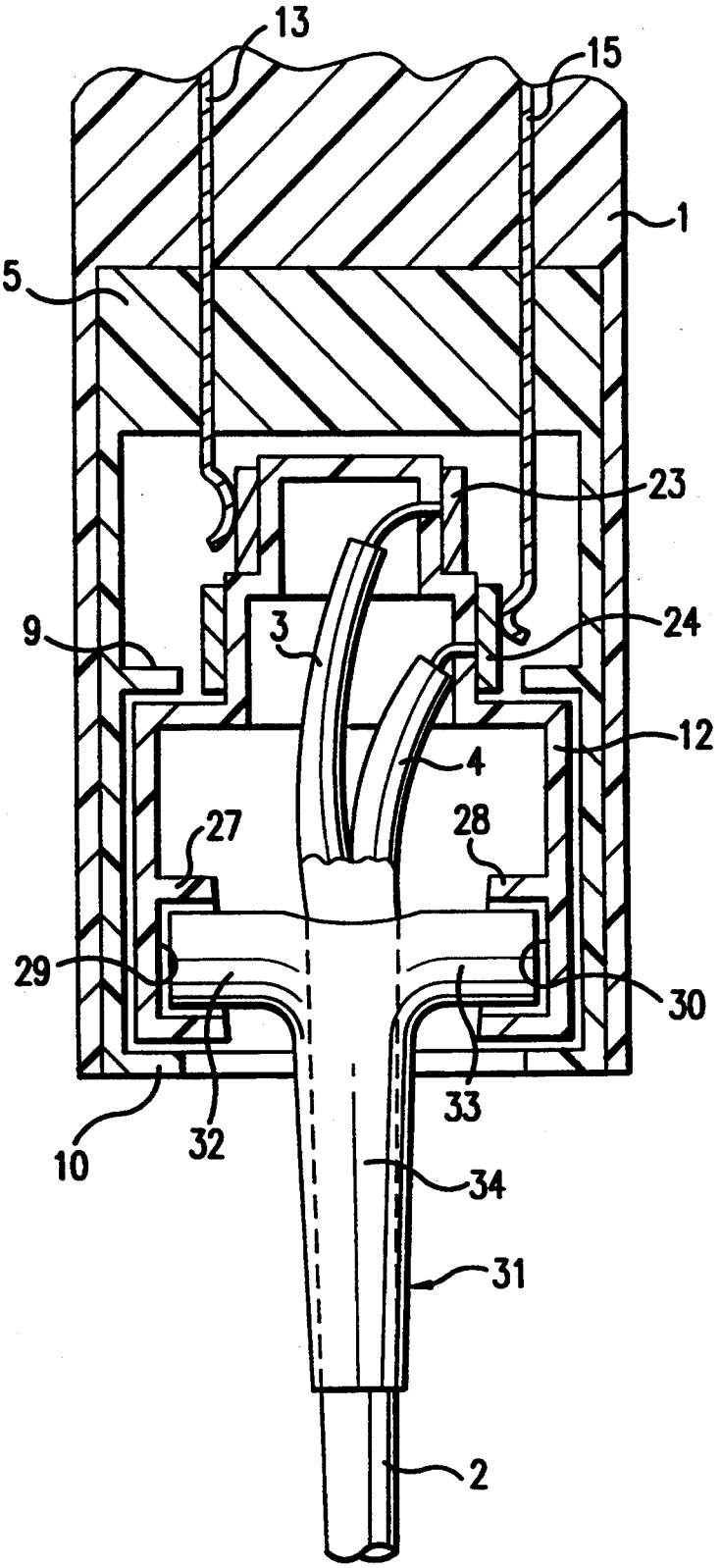
FIG. 1 is a side cross-sectional view of the connector of the present invention.

As shown in FIG. 1, the handle of a hand-held appliance, shown partially at 1, such as a hair dryer, curling iron, or electric toothbrush has a conventional electrical power cord 2 exiting therefrom and adapted to be plugged into an electrical power source at one end (not shown). The other end of the power cord 2 splits into two lead wires 3, 4 which carry the current from the electrical source to power the appliance.

Figure 2:
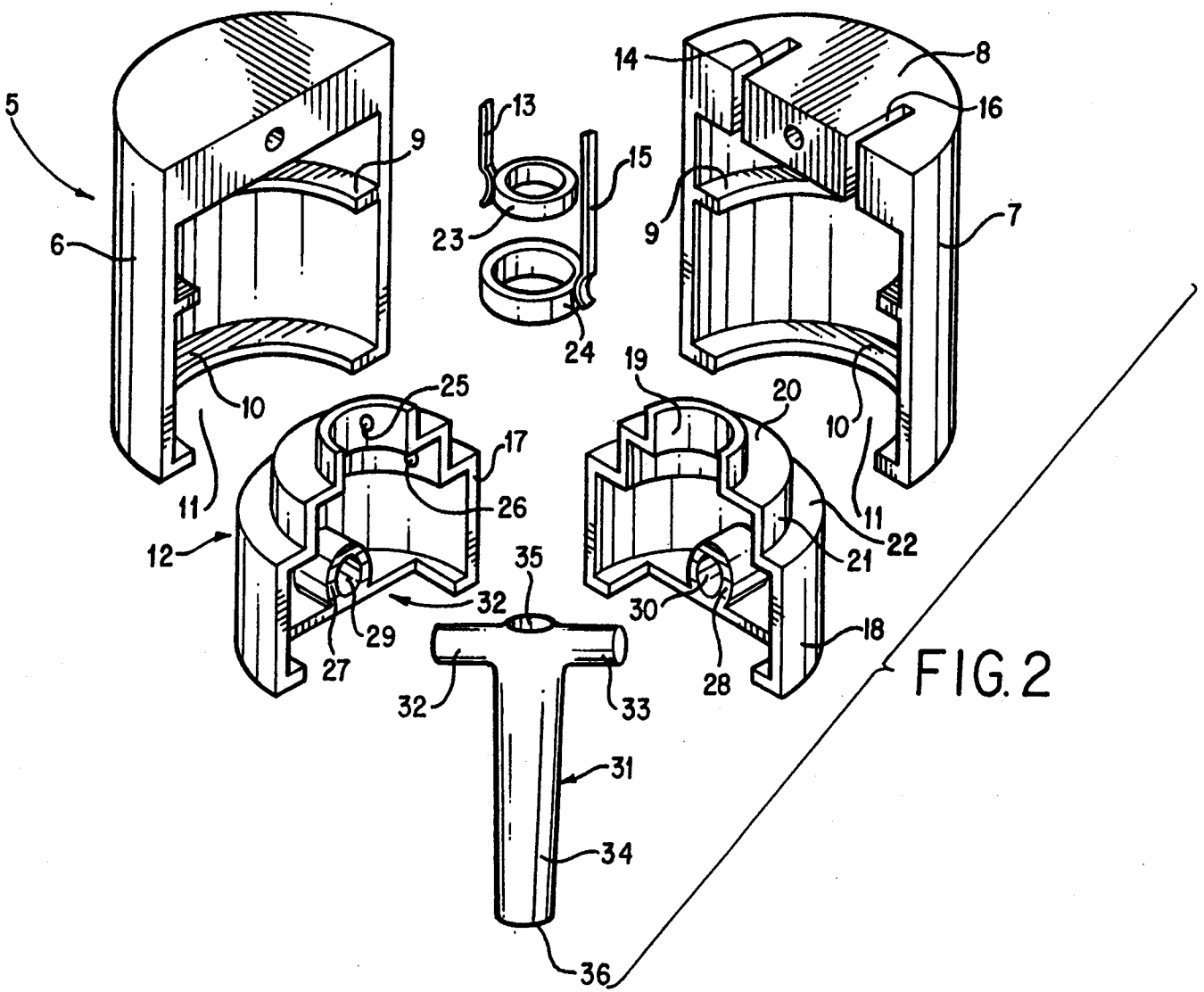
FIG. 2 is a perspective and exploded view of the connector of FIG. 1.

The connector of the present invention includes an outer case housing 5, which is held within the appliance 1 by either a compressive or friction fit within the inner body of appliance 1, or by some other means of securement. Alternatively, the outer casing 5 can be an integrally formed part of the inner body of appliance 1. The case housing 5 preferably consists of a cylindrical hollow left chamber half 6 and a cylindrical hollow right chamber half 7, as clearly shown in FIG. 2. Of course, the two outer case halves can alternatively be top and bottom halves instead. In a preferred embodiment, the outer case housing 5 has a top cover portion 8, two slits 14 and 16, an annular internal central flange 9 and a bottom flange 10 with an annular base opening 11. The central and bottom flanges serve to rotatively support an inner main housing therewithin and prevent vertical movement thereof. A first prong-like elongated spring 13 (contact brush) extends through slit 14 in cover portion 8, and a second similar spring 15 extends through slit 16. The springs 13, 15 are fixedly held in place in slits 14, 16. The springs 13, 15 are electrically connected at one end to a switch assembly (not shown) of the appliance. In an alternative embodiment (not shown), the springs can be fastened to an interior wall of the outer case housing and extend radially therefrom to the center of the outer case housing chamber.

Inner main housing 12 acts as a rotor relative to the outer case housing 5. Inner main housing 12 is rotatively supported between central flange 9 and bottom flange 10 of outer casing 5. Inner main housing 12 typically consists of left half 17 and right half 18, each of which is a generally cylindrical hollow member having a stepped portion at the top thereof. Of course, as with outer case housing 5, the two halves of inner main housing 12 can possibly be top and bottom halves instead. The stepped portion of inner main housing 12 has a first ring portion 19, a first step 20, a second ring portion 21, and a second step 22. Metal conductor slip rings 23, 24 fit concentrically about ring portions 19, 21 respectively, sitting atop steps 20, 22, respectively. Conductor slip rings 23 and 24 are held via a compressive friction fit onto the exterior of ring portions 19 and 21. Through-holes 25, 26 in ring portions 19, 21 provide openings through which exposed lead wires 3, 4 can pass and electrically contact slip rings 23, 24, respectively. In turn, conductor rings 23, 24 are in electrical contact with springs 13, 15 extending downwardly from cover 8 of case housing 5. Alternatively, as previously mentioned, the springs may extend radially inward from an interior wall of case housing 5 in direct electrical contact with conductor rings 23, 24. The compressive force of springs 13, 15 against conductor rings 23, 24 assures continuous electrical contact therebetween, even upon movement thereof caused by the rotating motion of inner main housing 12. The connection created between the electrical power source, power cord 2, lead wires 3, 4, conductor rings 23, 24, spring contacts 13, 15 and the switch/motor assembly of appliance 1 completes the electrical circuit to power the appliance. The conductor slip rings 23, 24 not only conduct electricity from the power cord 2, but also help to maintain inner main housing halves 17 and 18 together via a compressive force. Additionally, the tight fit of conductor rings 23, 24 around ring portions 19, 21 further serves to firmly and tightly wedge the exposed lead wires 3, 4 between the outside surface of ring portions 19, 21, respectively, and the inside surface of conductor rings 23, 24, respectively. This further prevents the power cord 2 from being yanked out of the appliance body.

The bottom portion of inner main housing 12 typically consists of a left bearing half 27 and left socket 29, and a right bearing half 28 and right socket 30 for supporting a T-shaped cord bushing 31. Bearings 27, 28 can be integrally formed with the bottom of inner main housing 12. The bottom of inner main housing 12 has a rectangular opening 32 large enough to permit cord bushing 31 to extend therethrough and have a pendulum motion of close to 90 degrees.

T-shaped cord bushing 31 has a horizontal top portion with oppositely extending cylindrical arms 32, 33 and a central lower vertical portion 34 with a bore therethrough creating openings at the top 35 and bottom 36 of cord bushing 31. The arms 32, 33 rotatively fit into sockets 29, 30 formed within bearings 27, 28 of inner main housing halves 17, 18, respectively, to provide a rocking motion to the cord bushing 31.

The power cord 2 extends through the bore of the cord bushing vertical portion 34 and is integrally molded with the top 35 and bottom 36 openings thereof. This provides strength to the part of the connection at the joint of power cord 2 and appliance body 1. This also serves to further prevent the possibility of power cord 2 from being yanked out of the appliance body.

Preferably, the outer case housing 5, the inner main housing 12, and cord bushing 31 are injection molded from a suitable low-friction plastic insulative resin such as polypropylene, acetal, nylon and polyesters. Preferably, the cord bushing 31 is molded to the power cord 2. The conductor slip rings 23, 24, inner main housing 12 and lead wires 3, 4 extending through holes 25, 26 must be properly dimensioned to allow for a good, custom fit.

As is evident, the power cord 2 has two axes of movement; one of which is a rotating motion about a central axis of inner main housing 12. As cord bushing 31 rotates, it drives inner main housing 12 in similar freely rotating fashion within outer case housing 5. Even though conductor slip rings 23 and 24 rotate along with inner main housing 12, the elongated springs 13 and 15 extending vertically downward (or radially inward) from outer case housing 5 remain firmly compressed against the outer surfaces of conductor slip rings 23 and 24, respectively, to maintain a continuous electrical circuit. The second axis of movement of the power cord is a pendulum motion created by the rocking of the cord bushing 31 within the rectangular opening 32 formed at the base of inner main housing 20. It should be understood that the power cord can rotate about the central vertical axis of outer case housing 5 even when cord bushing 31 is not perfectly vertical. To maintain an electrical contact while providing two axes of movement to a power cord is a great improvement over that heretofore known in the art.

It will of course be appreciated that the embodiment which has just been described has been given purely by way of illustration and may be modified as to detail without thereby departing from the basic principles of the invention. It is intended that such other modifications are encompassed within the scope of this description.

What is claimed is:

1. An electrical connector device for use in combination with a power cord and an electric appliance for providing the cord with two axes of free movement, the connector device comprising:

(a) a bushing means (1) peripherally surrounding a portion of the power cord, and (2) incorporating mounting means for enabling said bushing and power cord to freely rotate about a first axis and pivot about a second axis intersecting said first axis, and adopted thereby enabling the power cord to rotate and pivot the power cord relative to the appliance;

(b) a rotor means at least partially enclosing and rotatively and pivotally supporting the bushing means;

(c) an outer case means fixed to the interior of the appliance and enclosing and rotatively supporting the rotor means;

(d) at least one contact spring extending into the outer case; and (e) at least one conductor means in communication with the rotor means and electrically connected to said power cord and said contact spring.

2. A connector device as in claim 1 wherein the outer case and the rotor means are cylindrical.

3. A connector device as in claim 1 wherein the appliance is a hairdryer.

4. A connector device as in claim 1 wherein the outer case and rotor means are formed of injection-molded plastic and each is formed by joining two half-members.

5. A connector device as in claim 1 wherein the outer case has a top cover portion having at least one slot therethrough and said contact spring extends through the slot and contacts the conductor means.

6. A connector as in claim 1 wherein the conductor means is in electrical contact with the power cord.

7. A connector device as in claim 1 wherein the bushing means has oppositely extending arms and a vertical body portion with a bore therethrough, the power cord extends through the body portion bore, the arms are pivotally connected in the rotor means and the body portion extends through the outer case.

8. A connector device as in claim 7 wherein the arms are in pin and socket connection with bearings formed at the base of said rotor means.

9. A connector device as in claim 7 wherein the bushing means is T-shaped with the extending arms forming the top of the T.

10. An electrical connector device to connect an electric power cord to a hand-held electric appliance, comprising:

(a) an outer case housing having a chamber therein and at least one spring contact extending thereinto;

(b) a main housing rotatively supported in the outer case chamber; said main housing having two separated sockets therein, a stepped cylindrical top portion, and a bottom wall with an opening therethrough;

(c) at least one conductor means compressively positioned on the stepped cylindrical portion of the main housing, the conductor being electrically connected to the power cord and to the spring contact; and (d) a cord bushing having oppositely extending arms and a body portion with a bore therethrough, the power cord extending through the body portion bore, the arms being pivotly mounted in the separated sockets and the body portion extending through the bottom opening of the main housing;

wherein said electrical connector device provides said power cord with two free axes of movement.

11. A connector device as in claim 10 wherein the outer case housing and the main housing are cylindrical.

12. A connector device as in claim 10 wherein the outer case housing and main housing are formed of injection molded plastic and each is formed by joining two symmetric half-members.

13. A connector device as in claim 10 wherein the outer case housing has a top cover portion having at least one slit therethrough and said spring contact extends through said slit and contacts said conductor means.

14. A connector device as in claim 10 wherein the cord bushing is T-shaped with the extending arms forming the top of the T.

15. A connector device as in claim 10 wherein the power cord is a two-conductor wire cord, the outer case housing comprises two spring contacts extending into the chamber thereof, the conductor means are two metal rings compressively positioned on the stepped cylindrical portion of the main housing, the spring contacts extend into the outer case housing with each spring contact in electrical connection with a respective ring, and each ring is in electrical connection with a respective conductor wire.

16. A connector device as in claim 10 wherein said body portion is adapted to rotate about a central axis of the main housing.

17. A connector device as in claim 16 wherein said body portion extending through said main housing is adapted to pivot in pendulum fashion about an axis transverse to said central axis of rotation.

* * * * *